US007814572B2

(12) United States Patent
Van Trojen

(10) Patent No.: US 7,814,572 B2
(45) Date of Patent: Oct. 19, 2010

(54) REUSABLE CUFF BARRIER

(75) Inventor: Don Van Trojen, Mukilteo, WA (US)

(73) Assignee: Paadz Products, Inc., Everett, WA (US)

( * ) Notice: Subject to any disclaimer, the term of this patent is extended or adjusted under 35 U.S.C. 154(b) by 0 days.

(21) Appl. No.: 12/325,793

(22) Filed: Dec. 1, 2008

(65) Prior Publication Data

US 2009/0126068 A1 May 21, 2009

Related U.S. Application Data

(62) Division of application No. 11/253,153, filed on Oct. 18, 2005, now abandoned.

(51) Int. Cl.
*A41D 19/00* (2006.01)

(52) U.S. Cl. ..... 2/162; 2/170

(58) Field of Classification Search ..... None
See application file for complete search history.

(56) References Cited

U.S. PATENT DOCUMENTS 2,655,663 A * 10/1953 Hoagland ..... 2/270
3,710,790 A 1/1973 Lemon
4,011,596 A 3/1977 Chang
4,476,857 A 10/1984 Levine
5,070,541 A 12/1991 Goss
5,555,561 A * 9/1996 Plachta et al. ..... 2/457
5,674,189 A 10/1997 McDowell et al.
5,873,130 A 2/1999 Lafferty
6,715,159 B2 * 4/2004 Cormier ..... 2/457
6,775,844 B1 8/2004 Castillo

* cited by examiner

*Primary Examiner*—Katherine Moran
(74) *Attorney, Agent, or Firm*—Seed Intellectual Property Law Group PLLC

(57) ABSTRACT

Adjustable padding systems for garments, incorporating a pocket and a pad. The pocket is coupled to the garment and has a wide, proximal portion and a narrow, distal portion. The pad has corresponding wide and narrow portions. The narrow portion of the pad is longer than the length of the narrow portion of the pocket, but is adjustable in length. Accordingly, the location of the wide portion of the pad along the length of the garment can be adjusted by adjusting the length of the narrow portion of the pad.

14 Claims, 7 Drawing Sheets

REUSABLE CUFF BARRIER

BACKGROUND OF THE INVENTION

1. Field of the Invention

The present invention relates to devices for preventing liquid from entering a garment through the cuff.

2. Description of the Related Art

Individuals work, exercise or play in the rain or in other wet conditions, such as individuals washing a car or the windows of a house, pressure-washing a wall, fishing, directing traffic, etc., and who want to keep water or any other liquid from entering the cuff of their shirt, typically purchase rain gear with elastic cuffs. This is an imperfect solution, especially if the individual orients one or both hands upward for any length of time in wet conditions, such as in the rain or when working with water. Wearing gloves could provide a better liquid barrier; however, often the individual doesn't want to wear gloves, or the gloves interfere with the individual's ability to perform precise functions.

There is a need for a reusable cuff barrier that can be worn with or without gloves, that doesn't require taping, and/or that isn't integral with the garment.

BRIEF SUMMARY OF THE INVENTION

The present invention is directed toward a reusable cuff barrier that prevents liquid from entering a garment though its cuff. The barrier can be worn with or without gloves, and can be quickly and repeatedly removed and replaced. Embodiments of the invention can keep the wearer's hand warm and sleeves and arm dry, while working in wet conditions, even when the user's arm and hand are oriented upwards or otherwise toward the source of liquid.

In one particular embodiment, the cuff barrier incorporates a hollow, elongated body, a first fastener, and a second fastener. The hollow, elongated body has a continuous sidewall and is open at its proximal and distal ends. The proximal end is sized to encircle a user's arm and the cuff of a garment, and the distal end is sized to encircle the user's fingers. The sidewall has an opening therein located proximate the distal end for receiving the user's thumb during use. The first fastener is coupleable to the body near its proximal end, and is configured such that, during use, the user can selectively tighten the proximal end of the sidewall about the user's arm and the cuff of the garment to prevent liquid from entering the cuff barrier from the proximal end. The second fastener is coupleable to the body between the first fastener and the opening in the sidewall, and is configured such that, during use, the user can selectively tighten a central portion of the sidewall about the user's wrist to prevent liquid from entering the cuff of the garment.

In another embodiment, the cuff barrier incorporates a waterproof sidewall and first and second fasteners. The waterproof sidewall is adapted to extend over and conform to at least a portion of a user's hand and forearm, and has an opening therein for receiving the user's thumb during use. The first and second fasteners in this particular embodiment can be similar to those described above.

In yet another embodiment, the cuff barrier incorporates a resilient, waterproof sidewall and a fastener. The resilient, waterproof sidewall is adapted to extend over and conform to at least a portion of a user's hand and forearm, and has an opening therein for receiving the user's thumb during use. The sidewall is sized to expand around a base of the user's hand, and is sufficiently resilient to contract to form a seal about the base of the user's hand. The fastener is coupleable to the sidewall and is configured such that, during use, the user can selectively tighten a proximal end of the sidewall about the user's arm and a cuff of a garment to prevent liquid from entering the cuff barrier from the proximal end.

BRIEF DESCRIPTION OF THE SEVERAL VIEWS OF THE DRAWING(S)

In order to assist understanding of the present invention, embodiments will now be described, purely by way of non-limiting example, with reference to the attached drawings, in which.

Figure 1:
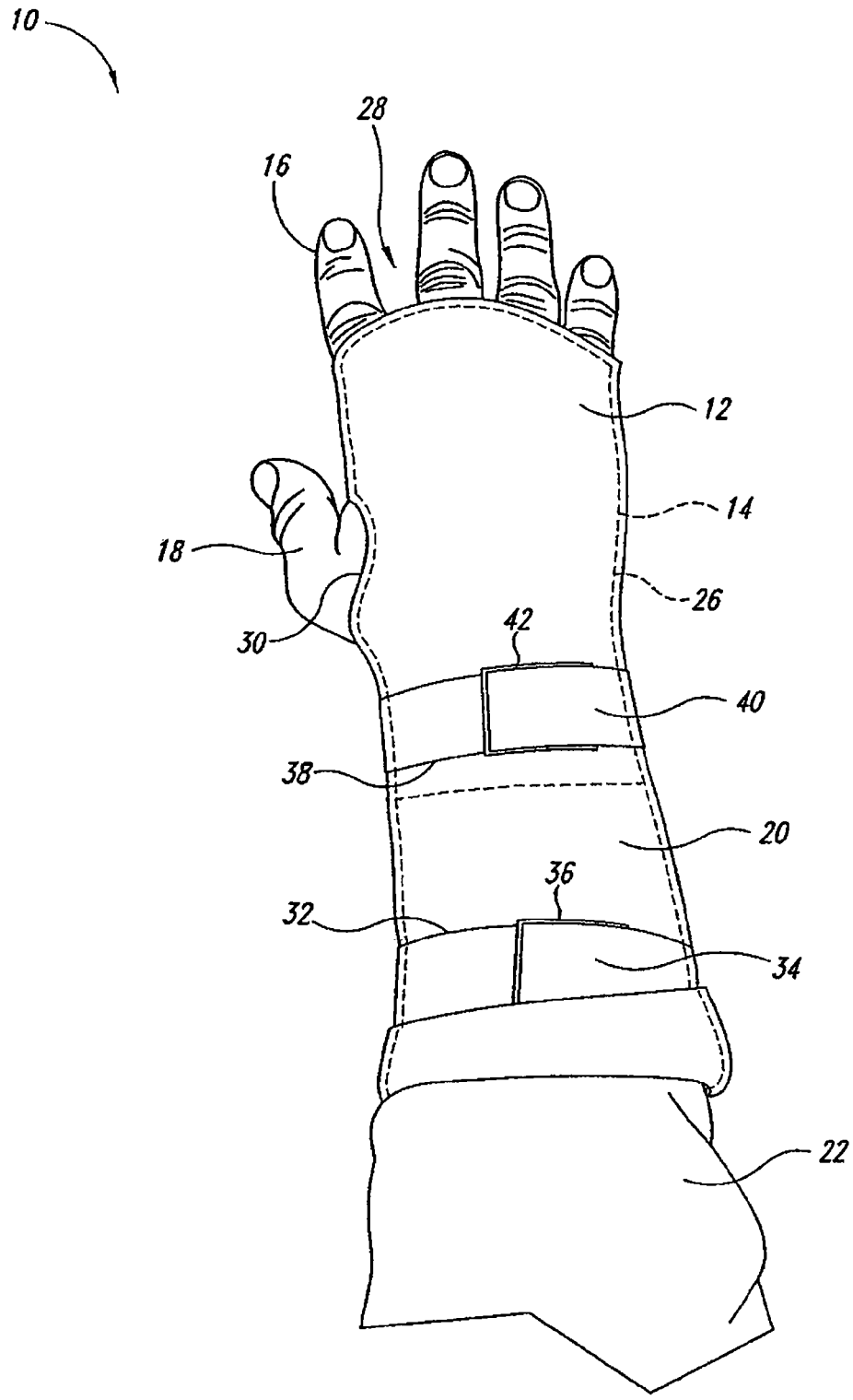
FIG. 1 is an isometric back view a cuff barrier according to one particular embodiment of the present invention being worn over a garment, without a glove.
Figure 2:
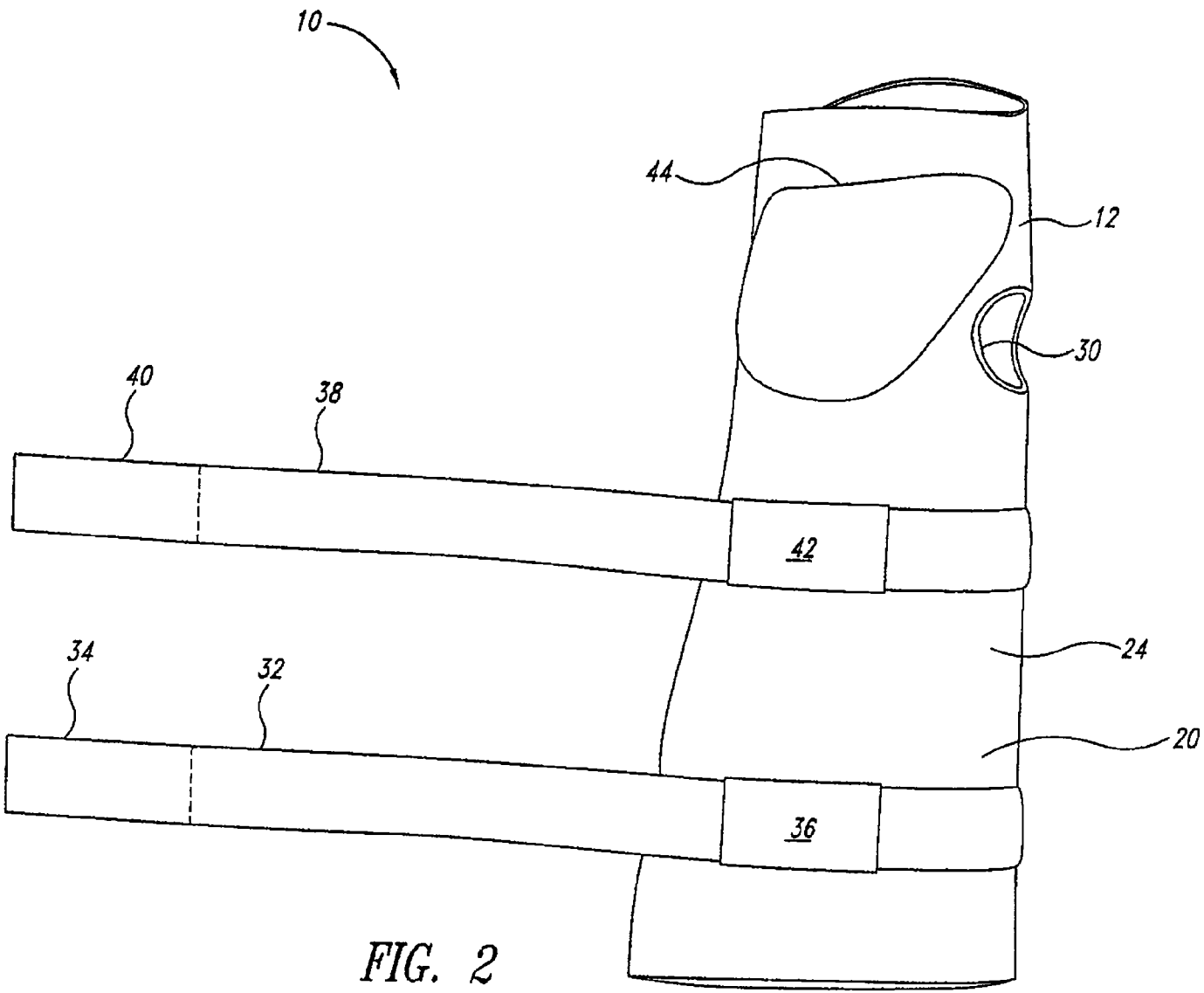
FIG. 2 is a plan view of the cuff barrier of FIG. 1, viewed from the front.
Figure 3:
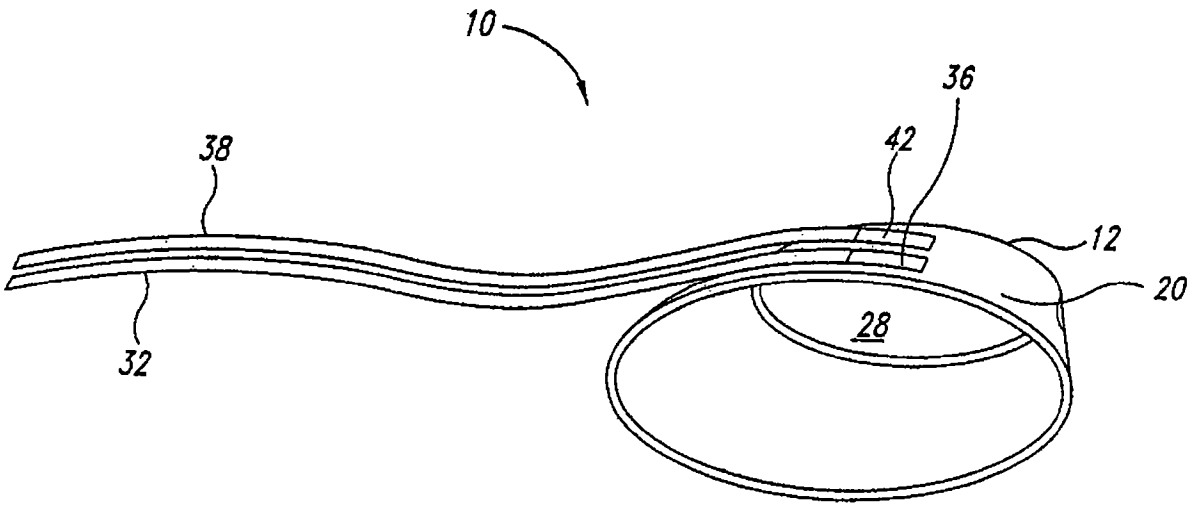
FIG. 3 is an end view of the cuff barrier of FIG. 1, viewed from the top as oriented in FIG. 1.
Figure 4:
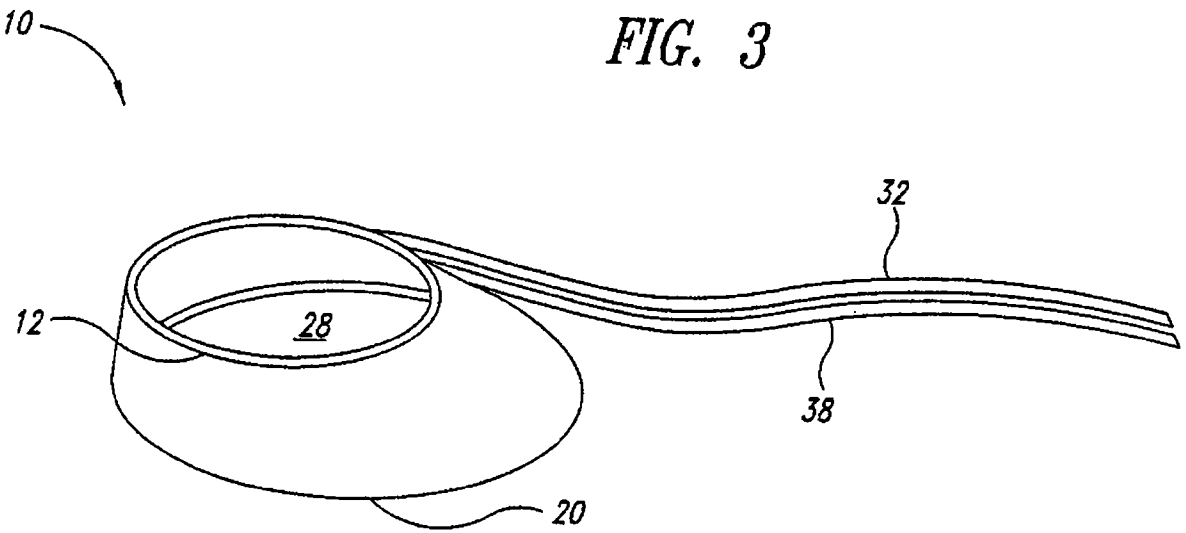

FIG. 4 end view of the cuff barrier of FIG. 1, viewed from the bottom as oriented in FIG. 1.

Figure 5:
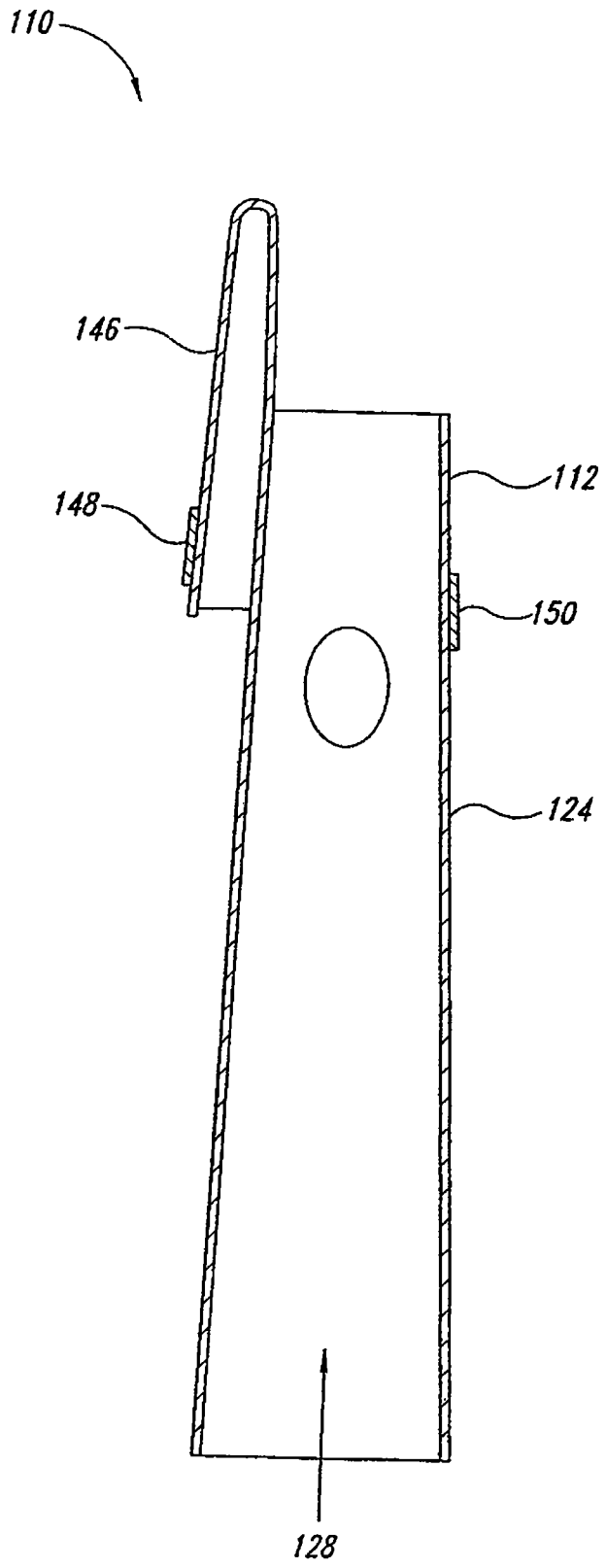

FIG. 5 is a cross-sectional side view of a cuff barrier according to another particular embodiment of the present invention, shown with a finger cover oriented in an open configuration.

Figure 6:
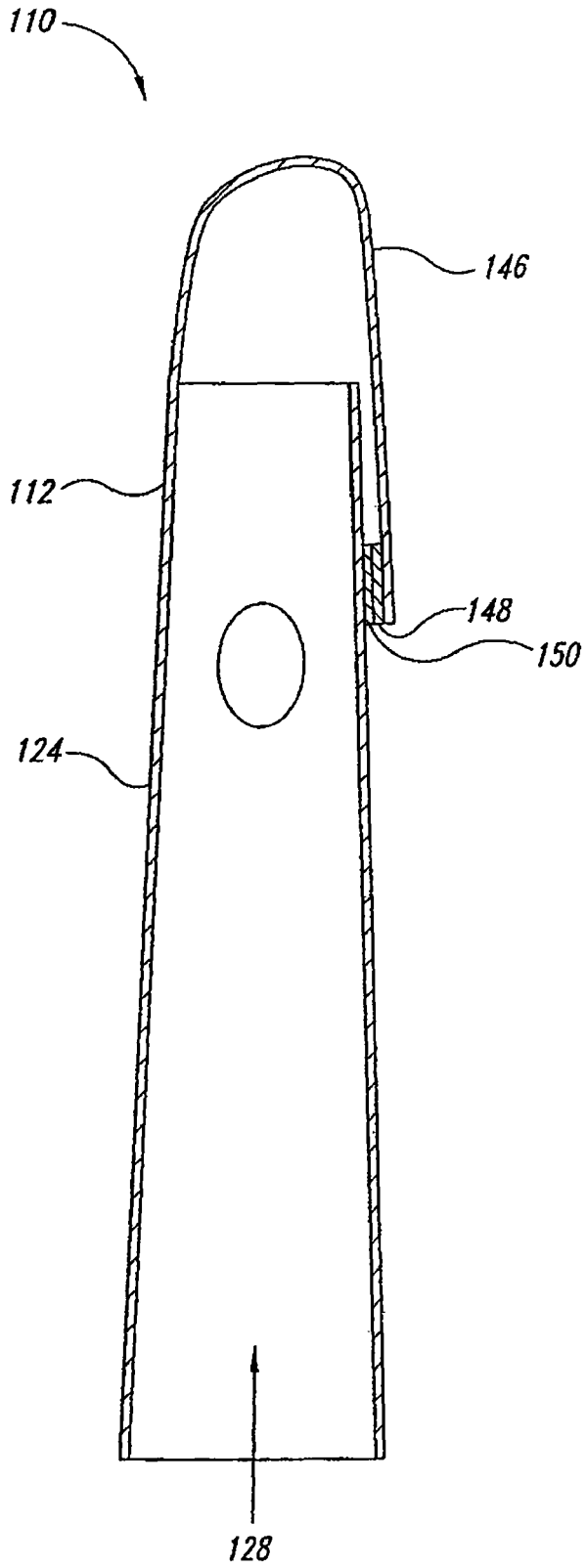

FIG. 6 is a cross-sectional side view of a cuff barrier according to another particular embodiment of the present invention, shown with a finger cover oriented in a closed configuration.

Figure 7:
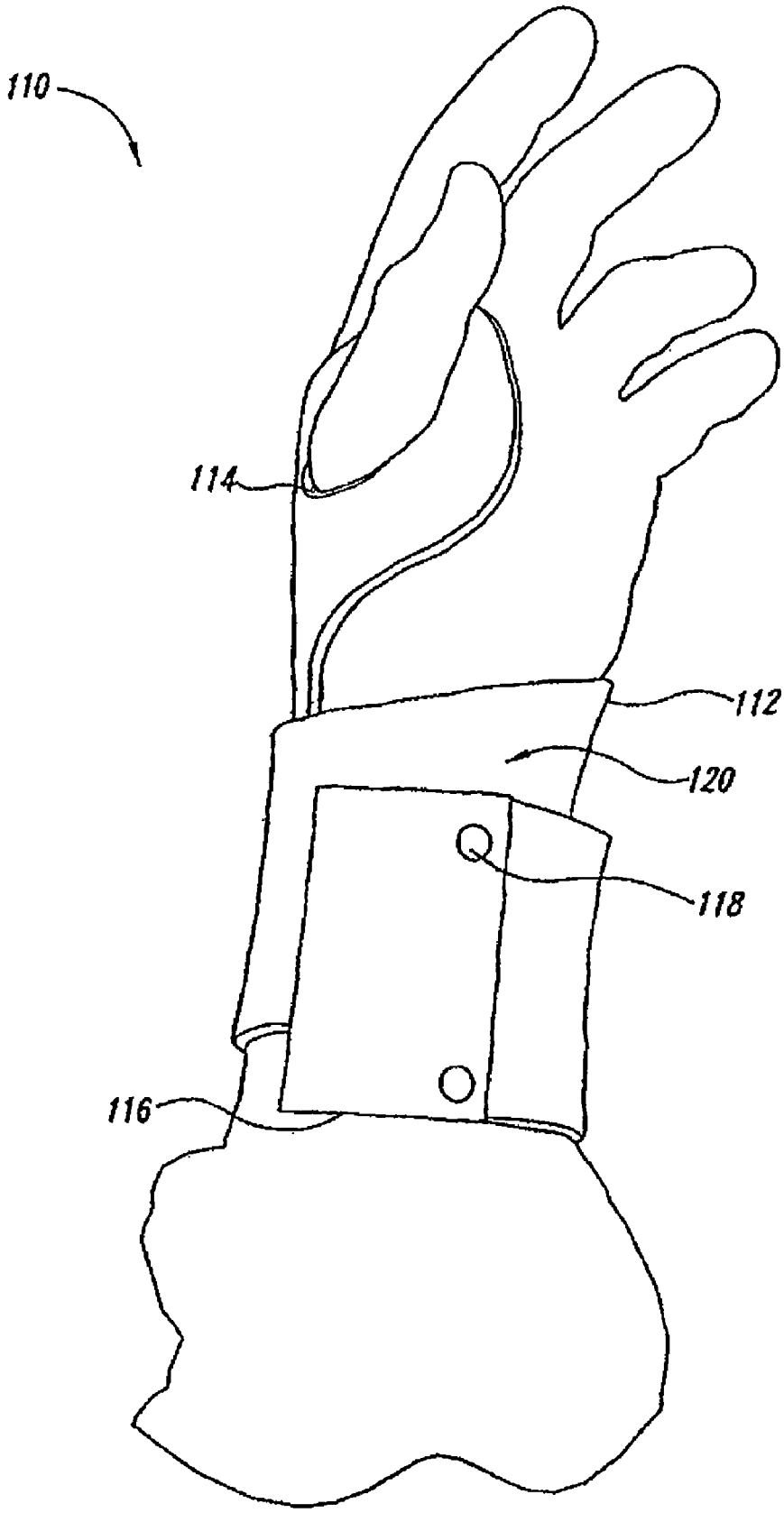

FIG. 7 is an isometric view of a cuff barrier according to yet another embodiment of the present invention, shown during use.

Figure 8:
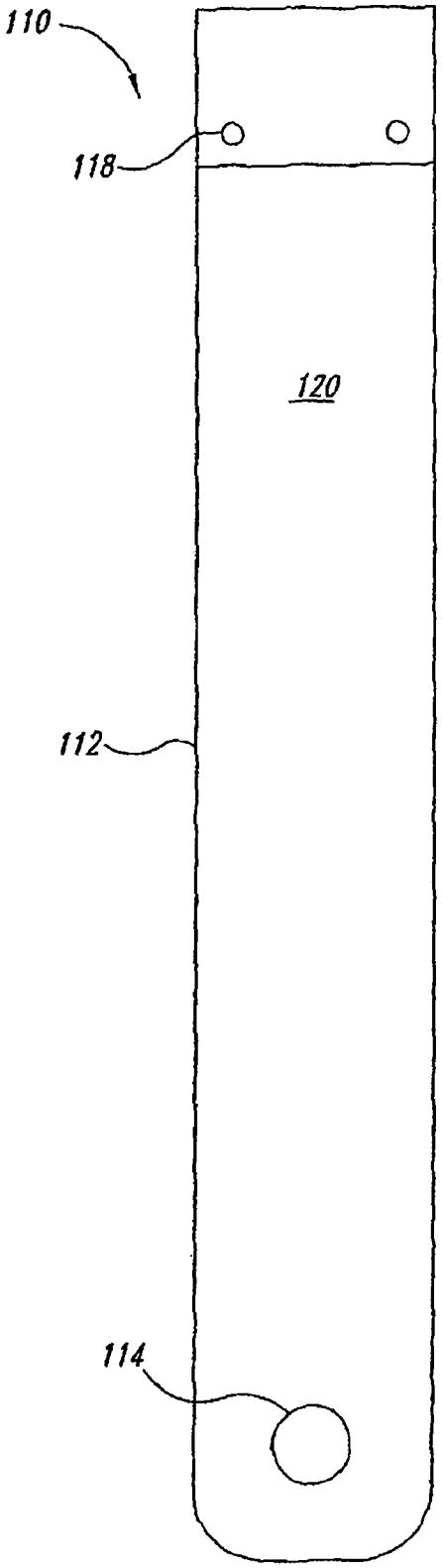

FIG. 8 is a plan view of the cuff barrier of FIG. 7, shown outstretched.

Figure 9:
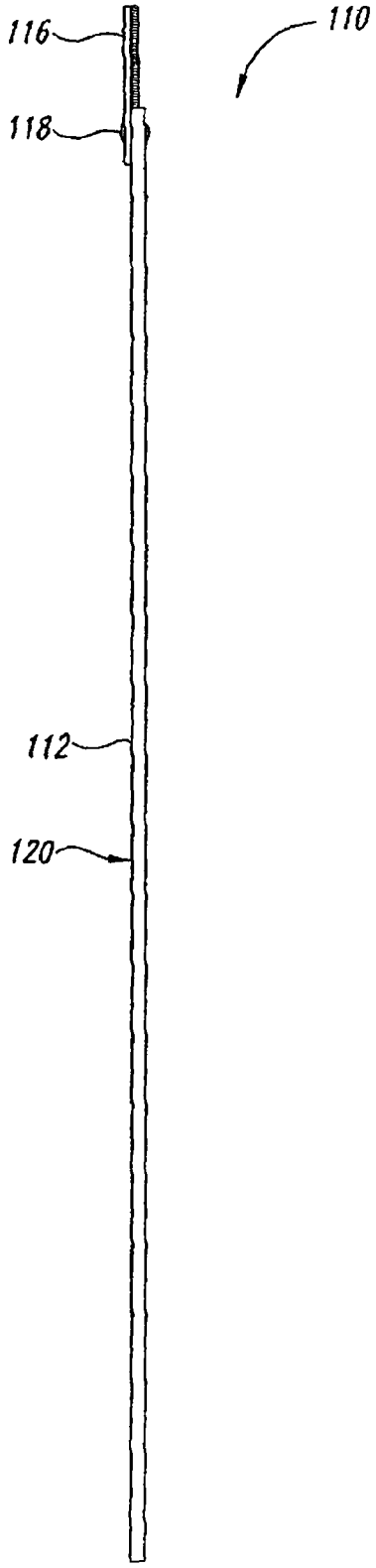

FIG. 9 is a side view of the cuff barrier of FIG. 8.

DETAILED DESCRIPTION OF THE INVENTION

The following detailed description is directed toward various embodiments of devices for preventing liquid from entering into the cuff of a garment.

FIGS. 1-4 illustrate one particular embodiment of a cuff barrier 10, having an elongated, hollow body, or sleeve, with a distal end 12 worn over a user's hand 14 such that the fingers 16 and thumb 18 are exposed for use, and having a proximal end 20 worn over a cuff 22 of a garment. A central portion 24 of the illustrated embodiment of the cuff barrier 10, between the distal end 12 and the proximal end 20, is positioned generally over the user's wrist 26.

The cuff barrier 10 is hollow, having a bore 28 extending along the length of its body. The bore 28 is sized to receive the user's hand 14 from the proximal end 20, and to allow the user to slide the hand through the bore until the thumb 18 has exited through an opening 30 in the sidewall of the cuff barrier 10 and the fingers 16 have exited the distal end 12 of the cuff barrier. In this configuration, the user's cuff 22 is abutted with the proximal end 20 of the cuff barrier 10.

The illustrated cuff barrier 10 can be manufactured from any suitable waterproof material, such as neoprene. In addition, some or all of the material can be resilient, allowing the cuff barrier 10 to flex when the user's hand 14 bends at the wrist 26. This resiliency can help prevent liquid from entering the user's cuff 22 during rotation of the wrist 26, and could possibly prevent overuse injuries, such as carpal tunnel syndrome. The resilient material could extend in a strip along the length of the cuff barrier 10, or the entire cuff barrier can be made from a resilient material. An individual of ordinary skill in the art, having reviewed this entire disclosure, will appreciate the types of waterproof and/or resilient materials that would be suitable for such purposes.

The cuff barrier 10 can be solid in color or camouflaged; it can be a flat color or have a hi-visibility finish, such as "neon" or reflectorized; and/or it can be designed to heat resistant/insulative, puncture/cut resistant. One of ordinary skill in the art, having reviewed this disclosure, will appreciate these and other variations that can be made to the illustrated embodiment without deviating from the spirit of the invention.

The proximal end 20 of the illustrated cuff barrier 10 can initially be flared out (see FIG. 2) to provide additional room for the cuff barrier to receive the cuff 22 therein. After the user has pulled on the cuff barrier 10, the cuff 22 can be inserted into the proximal end 20 of the cuff barrier.

A first, or proximal fastener 32 is attached at one of its ends near the proximal end 20 of the cuff barrier 10, and the other end of the proximal fastener 32 is free. The free end 34 of the proximal fastener 32 can have hook-and-loop fastener material affixed thereto. A patch 36 of complementary hook-and-loop fastener material is affixed to the cuff barrier 10 at another location spaced apart about the proximal end 20 of the cuff barrier. The free end 34 of the proximal fastener 32 thus can be releasably attached to the patch 36. In order for the free end 34 to align with the patch 36, however, the proximal fastener 32 must be pulled tangentially around the cuff until the proximal end 20 of the cuff barrier 10 has tightened about the cuff 22 and the user's forearm, creating a liquid-tight seal. The respective sizes and locations of the free end 34 and the patch 36 can be selected to allow the user to adjust how tightly the proximal end 20 of the cuff barrier 10 squeezes the cuff 22 and forearm.

Similarly, a second, or central fastener 38 can be attached at one of its ends near the central portion 24 of the cuff barrier 10, and the other end of the central fastener 38 is free. The free end 40 of the central fastener 38 can have hook-and-loop fastener material affixed thereto. A patch 42 of complementary hook-and-loop fastener material can be affixed to the cuff barrier 10 at another location spaced apart about the central portion 24 of the cuff barrier. The free end 40 of the central fastener 38 thus can be releasably attached to the patch 42. In order for the free end 40 to align with the patch 42, however, the central fastener 38 must be pulled tangentially around the cuff until the central portion 24 of the cuff barrier 10 has tightened about the user's wrist 26, creating a liquid-tight seal. The respective sizes and locations of the free end 40 and the patch 42 can be selected to allow the user to adjust how tightly the central portion 24 of the cuff barrier 10 squeezes the wrist 26.

In alternate embodiments, the central portion 24 of the cuff barrier 10 can be sufficiently narrow and resilient to squeeze the base of the user's hand 14 to naturally create a seal. Such a design may eliminate the need for a central fastener 38. In such embodiments, highly resilient and waterproof materials, such as neoprene, may be preferred. An individual of ordinary skill in the art, having reviewed this entire disclosure, will appreciate the specific requirements for such an embodiment.

A reinforced pad 44 can be positioned to cover the center of the user's hand 14, to provide additional grip and/or padding.

To use the cuff barrier 10, the user pulls the cuff barrier by the proximal end 20 over the hand and forearm, inserting the thumb 18 through the hole 30 along the way. The user then tucks the cuff 22 into the proximal end 20 of the cuff barrier and tightens the proximal fastener 32 over the cuff. Where applicable, the user can then tighten the central fastener 38 over the wrist. The user can then fish, wash a car, or do any other activity where fluid would otherwise run up their arm into their shirtsleeve, and the cuff barrier will keep the user's arm dry.

If the cuff barrier 10 were going to be used with irritating fluids or other fluids that the user desires maintaining away from the skin, the user can wear the cuff barrier over a rubber, latex or other protective glove. The glove would prevent the fluid from contacting the user's fingers 16, thumb 18 and hand 14. Further, the base of the glove would extend below the central portion 24 of the cuff barrier 10, such that the central fastener 38 and the cuff barrier 10 would prevent fluid entering the distal end 12 of the cuff barrier from contacting the user's skin. As discussed above, the proximal fastener 32 and the cuff 22 would prevent the fluid from entering the proximal end 20 of the cuff barrier 10. Thus the user's entire hand 14, wrist 26 and forearm would be protected from the fluid.

If the cuff barrier 10 were going to be used in cold weather, the user could wear insulated gloves, with or without fingers, and could again tighten the central fastener over the cuff barrier and glove to prevent fluid entering the distal end 20 of the cuff barrier from entering the cuff 22 of the garment.

The extreme proximal end 20 of the illustrated cuff barrier 10 can be rolled outward to form a gutter around the outside of the cuff barrier, which will stop and/or divert water from flowing over the entire cuff barrier and onto the user's arm.

After use, or between uses, the user can quickly and easily remove the cuff barrier 10 by releasing the proximal fastener 32 and, where applicable, the central fastener 38, then pulling the cuff barrier by the distal end 12 off the forearm.

FIGS. 5 and 6 illustrate one particular alternate embodiment of a cuff barrier 110. In this particular embodiment, a cover 146 projects from the distal end 112 of the cuff barrier, and can be folded from an open configuration (FIG. 5) to a closed configuration (FIG. 6) to cover the user's fingers. A cover fastener 148 can be affixed to the cover 146, and a complementary body fastener 150 can be attached between the distal end 112 and the central portion 124 of the body, such that when the cover 146 is in the closed configuration, the cover fastener engages the body fastener to retain the cover in the closed position.

FIGS. 7-9 illustrate another possible alternate embodiment of a cuff barrier 110. In the illustrated embodiment, the cuff barrier 110 is made with an elongated, elastic- or resilient-body 112, having an opening 114 at or near one end and a fastener 116 at or near an opposing end. The opening 114 is sized to allow the user to insert a thumb therethrough, to fix one end of the body 112 with respect to the user. The body 112 is sufficiently long between the opening 114 and the fastener 116 to extend around the user's wrist at least once. In the illustrated embodiment, the body 112 is sufficiently long to extend around the wrist twice. Depending on the size of the person's wrist and the application of the particular cuff barrier 110, the body 112 of a particular cuff barrier could be longer or shorter.

The illustrated fastener 116 is a patch of hook-and-loop material—either the hook portion or the loop portion—that has been attached to the elastic material of the body 112. The fastener 116 can be affixed in any known manner; however the illustrated fastener is attached, at least in part, using metal rivets 118 or the like.

An exterior surface 120 of the body 112 in the illustrated embodiment incorporates a loosely woven fabric to which the hooks of a hook-and-loop fastener will attach. Accordingly, if the fastener 116 incorporates hooks, the fastener can attach to the exterior surface 120 at any location along the length of the body 112. In alternate embodiments, a patch of hooks or loops could be affixed to the body 112, which would also be suitable.

This embodiment of the cuff barrier 110 is infinitely adjustable and its length is unrestricted. Also, the metal rivets 118 are detectable by assembly lines and other industrial machinery, which can help prevent the cuff barrier 110 from entering the equipment if it is accidentally being dropped by a worker.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A method of preventing liquid from entering a cuff of a garment worn by a user, the method comprising:

providing a cuff barrier comprising:

a hollow, elongate body having a continuous sidewall and being open at its proximal and distal ends, the proximal end being sized to encircle an arm of the user and the cuff of the garment, the distal end being sized to encircle fingers of the user, and the sidewall having an opening therein located proximate the distal end configured to receive a thumb of the user;

a first fastener coupleable to the body near the proximal end and being configured such that, during use, the user can selectively tighten the proximal end of the sidewall about the user's arm and the cuff of the garment to prevent liquid from entering the cuff barrier from the proximal end; and a second fastener coupleable to the body between the first fastener and the opening in the sidewall, the second fastener being configured such that, during use, the user can selectively tighten a central portion of the sidewall about a wrist of the user to prevent liquid from entering the cuff of the garment;

positioning the hollow, elongate body to encircle at least a portion of the user's arm and the cuff of the garment;

inserting the user's fingers through the distal end of the hollow, elongate body;

inserting the user's thumb through the opening in the sidewall of the hollow, elongate body; and tightening the proximal end of the sidewall about the user's arm and the cuff of the garment using the first fastener to create a substantially liquid-tight seal.

2. The method of claim 1, wherein the user is wearing a glove, the method further comprising:

positioning the hollow, elongate body to surround at least a portion of the glove; and tightening the central portion of the sidewall about the user's wrist and the glove using the second fastener to create a substantially liquid-tight seal.

3. The method of claim 1, wherein the hollow, elongate body is made entirely from a waterproof material.

4. The method of claim 1, wherein the distal end of the sidewall comprises an extension, the method further comprising:

moving the extension between an open configuration in which the user's fingers extend through the distal end of the hollow, elongate body, and a closed configuration in which the user's fingers are covered by material of the extension.

5. A method of preventing exposure to a liquid, the method comprising:

providing a cuff barrier;

wearing a glove on a hand of a user;

wearing a garment having a sleeve surrounding at least a portion of an arm of the user, at least a portion of the sleeve being waterproof;

positioning the cuff barrier to encircle at least a portion of the glove and the sleeve;

tightening the cuff barrier about the user's arm and the sleeve of the garment to create a substantially liquid-tight seal; and wherein providing the cuff barrier comprises:

providing a waterproof sidewall, the sidewall adapted to extend around and conform to at least a portion of the user's hand and arm, and having an opening therein configured to receive a thumb of the user during use;

providing a first fastener coupleable to the sidewall and being configured such that, during use, the user can selectively tighten a proximal end of the sidewall about the user's arm and the sleeve of the garment to prevent liquid from entering the cuff barrier from the proximal end; and providing a second fastener coupleable to the sidewall between the first fastener and the opening in the sidewall, the second fastener being configured such that, during use, the user can selectively tighten a central portion of the sidewall about a wrist of the user to prevent liquid from entering the sleeve of the garment.

6. The method of claim 5, further comprising:

tightening the cuff barrier about the glove to create a substantially liquid-tight seal.

7. The method of claim 5, wherein positioning the cuff barrier to encircle at least a portion of the glove and the sleeve further comprises:

positioning the sidewall to encircle at least a portion of the user's arm and the sleeve of the garment;

inserting fingers of the user through a distal end of the sidewall; and inserting the user's thumb through the opening in the sidewall.

8. A method of preventing exposure to a liquid, the method comprising:

providing a cuff barrier;

wearing a glove on a hand of a user;

wearing a garment having a sleeve surrounding at least a portion of an arm of the user, at least a portion of the sleeve being waterproof;

positioning the cuff barrier to encircle at least a portion of the glove and the sleeve;

tightening the cuff barrier about the user's arm and the sleeve of the garment to create a substantially liquid-tight seal; and wherein providing the cuff barrier further comprises:

providing a resilient, waterproof wall adapted to extend around and conform to at least a portion of the user's hand and arm, the wall having an opening therein configured to receive a thumb of the user during use, the wall being sufficiently resilient to contract to form a seal about a base of the user's hand; and providing a fastener coupleable to substantially any location on the wall and being configured such that, during use, the user can selectively tighten a proximal end of the sidewall about the user's arm and the sleeve of the garment to prevent liquid from entering the cuff barrier from the proximal end.

9. The method of claim 8, wherein positioning the cuff barrier to encircle at least a portion of the glove and the sleeve further comprises:

inserting the user's thumb through the opening in the resilient, waterproof wall of the cuff barrier; and extending the wall to surround at least a portion of the user's arm and the sleeve of the garment.

10. A method of preventing exposure to a liquid, the method comprising:

providing a cuff barrier;

wearing a garment having a cuff surrounding at least a portion of a limb of a user, at least a portion of the garment being waterproof;

positioning the cuff barrier to encircle at least a portion of the cuff of the garment; and tightening the cuff barrier about the user's limb and the cuff of the garment to create a substantially liquid-tight seal;

wherein providing the cuff barrier further comprises:

providing a waterproof sidewall, the sidewall adapted to extend around and conform to at least a portion of the user's limb;

providing a first fastener coupleable to the sidewall and being configured such that, during use, the user can selectively tighten a proximal end of the sidewall about the user's limb and the cuff of the garment to prevent liquid from entering the cuff barrier from the proximal end; and providing a second fastener coupleable to the sidewall between the first fastener and a distal end of the sidewall, the second fastener being configured such that, during use, the user can selectively tighten a central portion of the sidewall about the user's limb to prevent liquid from entering the cuff of the garment.

11. The method of claim 10, wherein the garment comprises rain gear having the cuff at an end of a sleeve, the method further comprising:

wearing a glove on a hand of the user; and tightening the cuff barrier about the glove to create a substantially liquid-tight seal.

12. The method of claim 10, wherein positioning the cuff barrier to encircle at least a portion of the cuff of the garment further comprises:

positioning the sidewall to encircle at least a portion of an arm of the user and the cuff of the garment;

inserting fingers of the user through the distal end of the sidewall; and inserting a thumb of the user through an opening in the sidewall.

13. The method of claim 10, wherein providing the cuff barrier further comprises:

providing a resilient, waterproof wall adapted to extend around and conform to at least a portion of the user's limb; and providing a fastener coupleable to substantially any location on the wall and being configured such that, during use, the user can selectively tighten a proximal end of the sidewall about the user's limb and the cuff of the garment to prevent liquid from entering the cuff barrier from the proximal end.

14. A method of preventing exposure to a liquid, the method comprising:

wearing a garment having a cuff surrounding at least a portion of a limb of a user, at least a portion of the garment being waterproof;

providing a cuff barrier, wherein providing the cuff barrier further comprises providing a resilient, waterproof wall adapted to extend around and conform to at least a portion of the user's limb; and providing a fastener coupleable to substantially any location on the wall and being configured such that, during use, the user can selectively tighten a proximal end of the sidewall about the user's limb and the cuff of the garment to prevent liquid from entering the cuff barrier from the proximal end;

positioning the cuff barrier to encircle at least a portion of the cuff of the garment, wherein positioning the cuff barrier to encircle at least a portion of the cuff of the garment further comprises:

inserting a thumb of the user through an opening in the resilient, waterproof wall of the cuff barrier; and extending the wall to surround at least a portion of an arm of the user and the cuff of the garment;

tightening the cuff barrier about the user's limb and the cuff of the garment to create a substantially liquid-tight seal.

* * * * *